US008876989B2

(12) United States Patent
O'Hara et al.

(10) Patent No.: US 8,876,989 B2
(45) Date of Patent: Nov. 4, 2014

(54) LOW RHENIUM NICKEL BASE SUPERALLOY COMPOSITIONS AND SUPERALLOY ARTICLES

(75) Inventors: Kevin Swayne O'Hara, Boxford, MA (US); Laura Jill Carroll, West Chester, OH (US)

(73) Assignee: General Electric Company, Schenectady, NY (US)

( * ) Notice: Subject to any disclaimer, the term of this patent is extended or adjusted under 35 U.S.C. 154(b) by 1184 days.

(21) Appl. No.: 11/964,664

(22) Filed: Dec. 26, 2007

(65) Prior Publication Data

US 2011/0120597 A1 May 26, 2011

Related U.S. Application Data

(60) Provisional application No. 60/969,360, filed on Aug. 31, 2007.

(51) Int. Cl.
*C22C 19/05* (2006.01)

(52) U.S. Cl.
USPC ..... 148/428; 420/448

(58) Field of Classification Search
CPC ..... C22C 19/057
USPC ..... 148/428; 420/445, 448
See application file for complete search history.

(56) References Cited

U.S. PATENT DOCUMENTS 4,719,080 A 1/1988 Duhl
5,035,958 A 7/1991 Jackson
5,043,138 A 8/1991 Darolia
5,240,518 A * 8/1993 Wortman et al. ..... 148/404
5,399,313 A 3/1995 Ross et al.
5,435,861 A 7/1995 Khan et al.
5,451,142 A * 9/1995 Cetel et al. ..... 416/241 R
5,660,649 A 8/1997 Bornstein et al.
6,007,645 A 12/1999 Cetel et al.

(Continued)

FOREIGN PATENT DOCUMENTS

EP 1038983 A 9/2000
EP 1184473 A 3/2002

(Continued)

OTHER PUBLICATIONS

English Abstract and English Machine Translation of Harada et al. (JP 2005-097649)(2005).*

(Continued)

*Primary Examiner* — Jessee Roe
(74) *Attorney, Agent, or Firm* — General Electric Company; William Scott Andes

(57) ABSTRACT

Low rhenium nickel base superalloy compositions and articles formed from the superalloy composition are provided. The nickel base superalloy composition includes in percentages by weight: about 5-8 Cr; about 6.5-9 Co; about 1.3-2.5 Mo; about 4.8-6.8 W; about 6.0-7.0 Ta; if present, up to about 0.5 Ti; about 6.0-6.4 Al; about 1-2.3 Re; if present, up to about 0.6 Hf; if present, up to 1.5 C; if present, up to about 0.015 B; the balance being nickel and incidental impurities. Exemplary compositions are characterized by an Re ratio defined as the weight % of Re relative to the total of the weight % of W and the wt % of Mo, of less than about 0.3. Exemplary articles include airfoils for gas turbine engine blades or vanes, nozzles, shrouds, and splash plates.

20 Claims, 9 Drawing Sheets

(56) References Cited

U.S. PATENT DOCUMENTS

| | | | | |
|---|---|---|---|---|
| 6,074,602 | A | 6/2000 | Wukusick et al. | |
| 6,096,141 | A | 8/2000 | King et al. | |
| 6,521,053 | B1 * | 2/2003 | Grylls et al. | 148/280 |
| 6,673,308 | B2 | 1/2004 | Hino et al. | |
| 6,966,956 | B2 | 11/2005 | Koizumi et al. | |
| 2004/0229072 | A1 * | 11/2004 | Murphy | 428/627 |
| 2007/0163682 | A1 | 7/2007 | Tamaki et al. | |

FOREIGN PATENT DOCUMENTS

| | | | | |
|---|---|---|---|---|
| EP | 1201778 | A | 5/2002 | |
| JP | 60 141842 | A | 7/1985 | |
| JP | 60 141843 | A | 7/1985 | |
| JP | 05 008263 | B2 | 2/1993 | |
| JP | 08-041566 | A | 2/1996 | |
| JP | 09-157777 | A | 6/1997 | |
| JP | H10 168534 | A | 6/1998 | |
| JP | 2004 285472 | A | 10/2004 | |
| JP | 2005-097649 | * | 4/2005 | C22C 19/03 |

OTHER PUBLICATIONS

PCT International Search Report and Written Opinion issued Feb. 18, 2009 in connection with corresponding Application No. PCT/US2008/074168.

PCT International Search Report and Written Opinion issued Feb. 12, 2009 in connection with corresponding Application No. PCT/US2008/074171.

Office Action from corresponding JP Application No. 2010523067, dated Jun. 25, 2013.

Office Action from corresponding JP Application No. 2010523068, dated Jun. 25, 2013.

* cited by examiner

LOW RHENIUM NICKEL BASE SUPERALLOY COMPOSITIONS AND SUPERALLOY ARTICLES

CROSS-REFERENCE TO RELATED APPLICATIONS

This application claims priority to U.S. Provisional Application Ser. No. 60/969,360, filed Aug. 31, 2007, which is herein incorporated by reference in its entirety.

FIELD OF THE INVENTION

Embodiments disclosed herein pertain generally to nickel base superalloys and articles of manufacture comprising nickel base superalloys. Disclosed embodiments may be particularly suitable for use in articles disposed in the hottest, most demanding regions of an aeroengine, such as rotating turbine blades. Other disclosed embodiments may be more suitable for use in non-creep limited applications, such as turbine nozzles and shrouds.

BACKGROUND OF THE INVENTION

The efficiency of gas turbine engines depends significantly on the operating temperature of the various engine components with increased operating temperatures resulting in increased efficiencies. The search for increased efficiencies has led to the development of superalloys capable of withstanding increasingly higher temperatures while maintaining their structural integrity.

Nickel-base superalloys are used extensively throughout the aeroengine in turbine blade, nozzle, and shroud applications. Aeroengine designs for improved engine performance require alloys with increasingly higher temperature capability. Although shroud and nozzle applications do not require the same level of high temperature creep resistance as blade applications, they do require similar resistance to thermal mechanical failure and environmental degradation. Superalloys are used for these demanding applications because they maintain their strength at up to 90% of their melting temperature and have excellent environmental resistance.

Single crystal (SC) superalloys may be divided into "four generations" based on similarities in alloy composition and performance. A defining characteristic of so-called "first generation" SC superalloys is the absence of the alloying element rhenium (Re). For example, U.S. Pat. Nos. 5,154,884; 5,399,313; 4,582,548; and 4,209,348 each discloses superalloy compositions substantially free of Re.

A representative SC nickel-base superalloy is known in the art as AM1 having a nominal composition of: 6.0-7.0% Co, 7.0-8.0% Cr, 1.8-2.2% Mo, 5.0-6.5% W, 7.5-8.5% Ta, 5.1-5.5% Al, 1.0-1.4% Ti, 0.01 maximum % B, 0.01 maximum % Zr, and balance essentially Ni and C wherein C is specified as 0.01% (100 ppm) maximum. Mach 1 velocity cyclic oxidation Test at 2150° F. data for a Rene N4 superalloy and an AM1 superalloy are provided for comparative purposes in the accompanying Figures.

It was discovered that the addition of about 3 wt % Re to superalloy compositions provides about a 50° F. (28° C.) improvement in rupture creep capability and the accompanying fatigue benefits. Production alloys such as CMSX-4, PWA-1484 and Rene N5 all contain about 3 wt % Re. These "second-generation" alloys are disclosed, for example, in U.S. Pat. Nos. 4,719,080; 4,643,782; 6,074,602 and 6,444,057.

U.S. Pat. No. 4,719,080 provides a relationship between compositional elements called a "P-value" defined as $P=-200\ Cr+80\ Mo-20\ Mo^2-250\ Ti^2-50\ (Ti\times Ta)+15\ Cb+200\ W-14\ W^2+30\ Ta-1.5\ Ta^2+2.5\ Co+1200\ Al-100\ Al^2+100\ Re+1000\ Hf-2000\ Hf^2+700\ Hf^3-2000\ V-500\ C-15000\ B-500\ Zr$. The patent stresses that a higher "P-value" correlates with high strength in combination with stability, heat treatability, and resistance to oxidation and corrosion. In particular, the superalloy compositions disclosed in the patent are constrained by "P-values" greater than 3360.

U.S. Pat. No. 6,074,602 is directed to nickel-base superalloys suitable for making single-crystal castings. The superalloys disclosed therein include, in weight percentages: 5-10 Cr, 5-10 Co, 0-2 Mo, 3-8 W, 3-8 Ta, 0-2 Ti, 5-7 Al, up to 6 Re, 0.08-0.2 Hf, 0.03-0.07 C, 0.003-0.006 B, 0.0-0.04 Y, the balance being nickel and incidental impurities. These superalloys exhibit increased temperature capability, based on stress rupture strength and low and high cycle fatigue properties, as compared to the first-generation nickel-base superalloys. Further, the superalloys exhibit better resistance to cyclic oxidation degradation and hot corrosion than first-generation superalloys.

U.S. Pat. Nos. 5,151,249; 5,366,695; 6,007,645 and 6,966,956 are directed to third- and fourth-generation superalloys. Generally, third-generation superalloys are characterized by inclusion of about 6 wt % Re; fourth generation superalloys include about 6 wt % Re, as well as the alloying element Ru. These superalloy compositions illustrate the value of increased Re additions in terms of mechanical performance.

First generation SC superalloys do not offer the thermal mechanical failure (TMF) resistance or the environmental resistance required in many hot section components such as turbine nozzles and shrouds. Also, first-generation SC superalloys do not offer acceptable high temperature oxidation resistance for these components.

Currently, aeroengines predominantly use second-generation type superalloys in an increasing number of hot section applications. The alloying element Re is the most potent solid solution strengthener known for this class of superalloys and therefore it has been used extensively as an alloying addition in SC and columnar-grained directionally solidified (DS) superalloys. The second-generation superalloys exhibit exceptional high temperature oxidation capability balanced with satisfactory mechanical properties.

Known superalloy compositions having lower Re content have not been able to provide the properties obtainable from second-generation superalloys. In particular, in U.S. Pat. No. 4,719,080, the data for one alloy (namely, B1) having less than 2.9% Re show properties comparable to first-generation, i.e., no Re, superalloys. Thus, in the development of superalloy compositions, the trend has been to use at least 3 wt % Re to obtain a satisfactory balance of oxidation resistance and high temperature strength.

However, the cost of the raw materials, and the global shortage of Re in particular, provides a challenge to develop superalloy compositions able to provide the demonstrated improved mechanical properties and oxidation resistance of second generation superalloys, but at low, and preferably 0% Re levels. Heretofore, second-generation properties in nickel base superalloys having less than 3 wt % Re has previously not been attained.

Accordingly, it would be desirable to provide nickel-base superalloy compositions having less than 3 wt % Re content that are able to provide single-crystal and directionally solidified articles having required high temperature characteristics.

BRIEF DESCRIPTION OF THE INVENTION

The above-mentioned need or needs may be met by exemplary embodiments which provide nickel-base superalloy compositions able to provide the required thermal mechanical properties, creep strength, and oxidation resistance with reduced Re content as compared to second-generation (i.e. 3 wt % Re) superalloy compositions.

An exemplary embodiment provides a nickel base superalloy composition including, in percentages by weight: about 5-8 Cr; about 6.5-9 Co; about 1.3-2.5 Mo; about 4.8-6.8 W; about 6.0-7.0 Ta; if present, up to about 0.5 Ti; about 6.0-6.4 Al; about 1-2.3 Re; if present, up to about 0.6 Hf; if present, up to about 0-1.5 C; if present, up to about 0.015 B; the balance being nickel and incidental impurities; and wherein an Re ratio defined as the weight % of Re relative to the total of the weight % of W and the wt % of Mo, is less than about 0.3.

An exemplary embodiment provides a nickel base single-crystal article comprising a superalloy including, in percentages by weight: about 5-8 Cr; about 6.5-9 Co; about 1.3-2.5 Mo; about 4.8-6.8 W; about 6.0-7.0 Ta; if present, up to about 0.5 Ti; about 6.0-6.4 Al; about 1-2.3 Re; if present, up to about 0.6 Hf; if present, up to about 0-1.5 C; if present, up to about 0.015 B; the balance being nickel and incidental impurities.

An exemplary embodiment provides a gas turbine engine component cast from a nickel base superalloy composition consisting of: about 5-8 Cr; about 6.5-9 Co; about 1.3-2.5 Mo; about 4.8-6.8 W; about 6.0-7.0 Ta; if present, up to about 0.5 Ti; about 6.0-6.4 Al; about 1-2.3 Re; if present, up to about 0.6 Hf; if present, up to about 0-1.5 C; if present, up to about 0.015 B; the balance being nickel and incidental impurities, wherein an Re ratio defined as the weight % of Re relative to the total of the weight % of W and the wt % of Mo, is less than about 0.3.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 9:
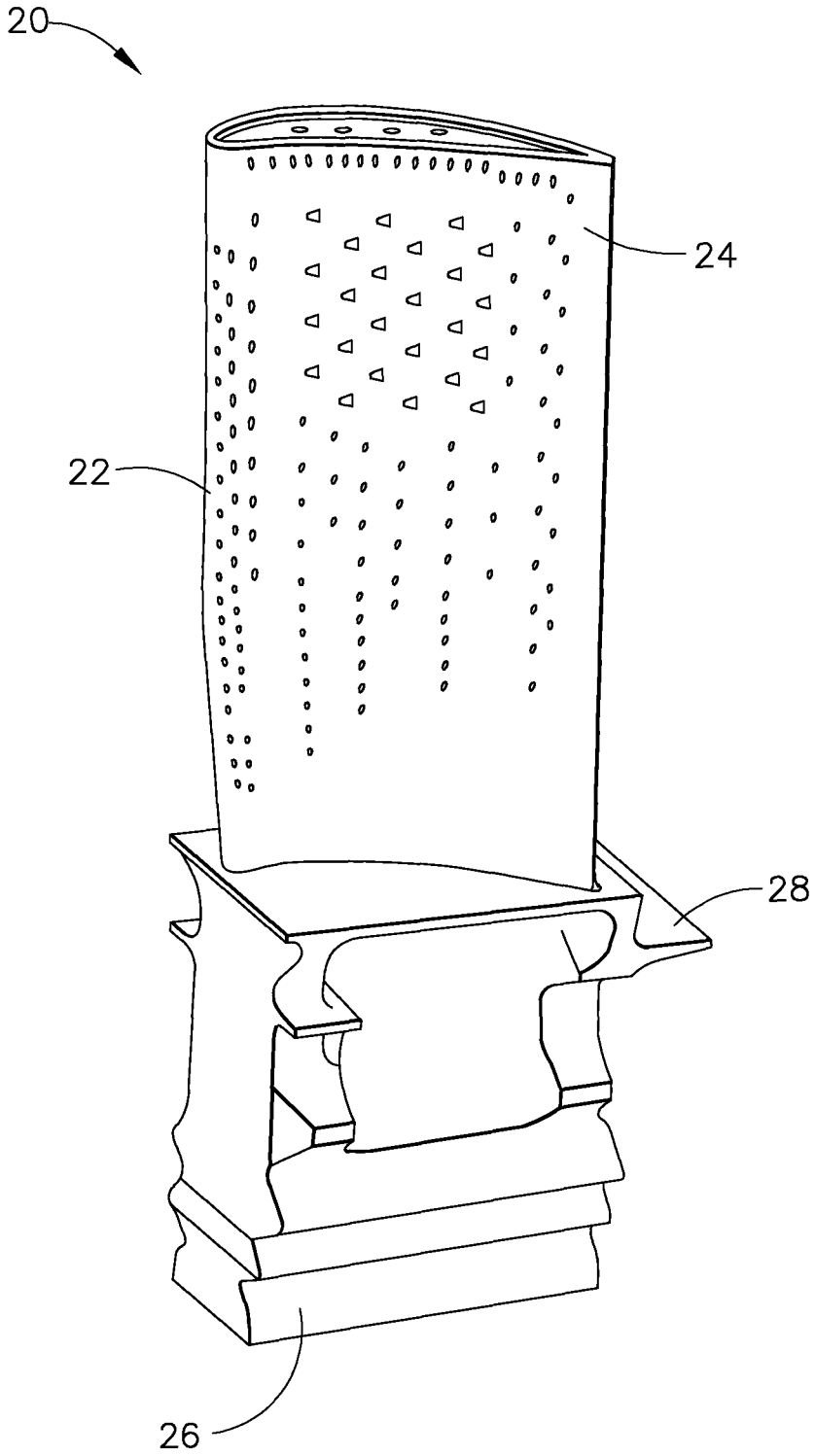
FIG. 9 is a schematic representation of an exemplary gas turbine engine turbine blade.

Referring to the drawings wherein identical reference numerals denote the same elements throughout the various views, FIG. 9 depicts a component article 20 of the gas turbine engine, illustrated as a gas turbine blade 22. The gas turbine blade 22 includes an airfoil 24, and attachment 26 in the form of the dovetail to attach the gas turbine blade 22 to the turbine disc (not shown), and a laterally extending platform 28 intermediate the airfoil 24 and the attachment 26. In one exemplary embodiment, a component article 20 is substantially a single crystal. That is, the component article 20 is at least about 80% by volume, and more preferably at least about 95% by volume, a single grain with a single crystallographic orientation. There may be minor volume fractions of other crystallographic orientations and also regions separated by low-angle boundaries. The single-crystal structure is prepared by the directional solidification of an alloy composition by methods known to those with skill in the art. In another exemplary embodiment, the component article 20 is a directionally oriented poly-crystal, in which there are at least several grains all with a commonly oriented preferred growth direction.

The use of the alloy composition discussed herein is not limited to the gas turbine blade 22, and it may be employed in other articles such as gas turbine vanes, or articles that are not to be used in gas turbine engines.

Embodiments disclosed herein balance the contributions of various alloying elements to the thermal mechanical properties, creep strength, and oxidation resistance of the compositions while minimizing detrimental effects. All values are expressed as a percentage by weight unless otherwise noted.

For example, certain embodiments disclosed herein include at least about 5% chromium (Cr). Amounts less than about 5% may reduce the hot corrosion resistance. Amounts greater than about 8% may lead to topologically close-packed (TCP) phase instability and poor cyclic oxidation resistance.

Certain embodiments disclosed herein include at least about 6.5% to about 9% Cobalt (Co). Other embodiments disclosed herein include about 7% to about 8% Co. Lower amounts of cobalt may reduce alloy stability. Greater amounts may reduce the gamma prime solvus temperature, thus impacting high temperature strength and oxidation resistance.

Certain embodiments disclosed herein include molybdenum (Mo) in amounts from about 1.3% to 2.5%. Other embodiments may include Mo in amounts of from about 1.3% to about 2.2%. The minimum value is sufficient to impart solid solution strengthening. Amounts exceeding the maximum may lead to surface instability. Greater amounts of Mo may also negatively impact both hot corrosion and oxidation resistance.

Certain embodiments disclosed herein include tungsten (W) in amounts from about 4.75% to about 6.75%. Lower amounts of W may decrease strength. Higher amounts may produce instability with respect to TCP phase formation. Higher amounts may also reduce oxidation capability.

Certain embodiments disclosed herein may include tantalum (Ta) in amounts from about 6.0% to about 7.0%. Other embodiments may include Ta in amounts from about 6.25% to about 6.5%.

Certain embodiments disclosed herein may include aluminum (Al) in amounts from about 6.0% to about 6.5%. Other embodiments may include from about 6.2% to about 6.5% Al.

Certain embodiments disclosed herein may optionally include up to about 0.5% titanium (Ti). Titanium is a potent gamma prime hardener. The optional Ti addition can strengthen the gamma prime phase, thus improving creep capability. However, oxidation resistance can be adversely affected by the addition of Ti, especially at levels greater than about 0.5%.

Certain embodiments disclosed herein, particularly those compositions for use in highest-temperature applications (i.e., turbine blades), may include rhenium (Re) in amounts of from about 1.0% to about 2.3%. The addition of Re at these levels provides the desired high temperature creep resistance of the superalloy. Re is a potent solid solution strengthener that partitions to the gamma phase. Re also diffuses slowly, which limits coarsening of the gamma prime phase.

Certain embodiments disclosed herein include hafnium (Hf) in amounts of from about 0.15% to about 0.6%. Hafnium is utilized to improve the oxidation and hot corrosion resistance of coated alloys and can improve the life of an applied thermal barrier coating. Hafnium additions of about 0.7% can be satisfactory, but additions of greater than about 1% adversely impact stress rupture properties and the incipient melting temperature.

Certain embodiments disclosed herein may include up to about 0.004% boron (B). B provides strains for low angle boundaries and enhanced acceptability limits for components having low angle grain boundaries.

Carbon (C) may be present in certain embodiments in amounts of from about 0.03% to about 0.06%. The lower limit provides sufficient C to allow for a cleaner melting alloy and to aid in promoting corrosion resistance.

Rare earth additions, i.e., yttrium (Y), lanthanum (La), and cerium (Ce), may be optionally provided in certain embodiments in amounts up to about 0.03%. These additions may improve oxidation resistance by enhancing the retention of the protective alumina scale. Greater amounts may promote mold/metal reaction at the casting surface, increasing the component inclusion content.

An exemplary embodiment includes a nickel base superalloy that may be utilized to produce single crystal articles, the superalloy including, in percentages by weight: 5-8 Cr, 6.5-9 Co, 1.3-2.5 Mo, 4.8-6.8 W, 6.0-7.0 Ta, 0.05-0.5 Ti, 6.0-6.4 Al, 1.0-2.3 Re, 0.15-0.6 Hf, 0-1.5 C, 0-0.015 B, with the balance including nickel and incidental impurities.

An exemplary embodiment includes a nickel base superalloy that may be utilized to produce single crystal articles, the superalloy including, in percentages by weight: 5-8 Cr, 6.5-9 Co, 1.3-2.5 Mo, 4.8-6.8 W, 6.0-7.0 Ta, 0-0.5 Ti, 6.0-6.4 Al, 1.0-2.3 Re, 0.15-0.6 Hf, 0-1.5 C, 0-0.015 B, with the balance including nickel and incidental impurities.

Exemplary embodiments include a nickel base superalloy that may be utilized to produce single crystal articles, the superalloy including about 6-7 Cr, about 7.5 Co, about 1.5-2.0 Mo, about 5-6.5 W, about 6.5 Ta, optionally up to about 0.5 Ti, about 6.2 Al, about 1-2.3 Re, about 0.15-0.6 Hf, about 0.03-0.05 C, about 0.004 B, the balance being nickel and incidental impurities. Certain of these exemplary embodiments are further characterized by P-values of less than 3360, wherein the P-values are determined in accordance with the relationship provided above. In exemplary embodiments, the P-values are less than 3245. In other exemplary embodiments, the P-values range from about 2954 to about 3242.

Exemplary embodiments disclosed herein may be characterized by an "Re Ratio" defined herein as the ratio of wt % Re to the total of wt % W plus wt % Mo. Certain embodiments disclosed herein thus compare amounts of Re, a potent strengthening agent to improve high temperature strength, to the amount of W and Mo, which are gamma strengthening refractory elements.

Certain embodiments disclosed herein include nickel base superalloy compositions comprising Mo, W and Re, wherein the Re ratio is less than about 0.30. For comparative purposes, the nominal composition of Rene N5 includes 5% W, 1.5% Mo, and 3.0% Re, yielding a Re ratio of 0.46. The nominal composition of PWA-1484 includes 6% W, 2% Mo, and 3% re, yielding a Re ration of 0.38. The nominal composition of CMSX-4 includes 6% W, 0.6% Mo, and 3% Re, yielding a Re ratio of 0.45.

For example, embodiments disclosed herein include nickel-base superalloy compositions including from about 5 to about 6.5 wt % W, from about 1.5 to about 2 wt % Mo, and from about 1 to about 2.3 wt % Re, wherein the Re ratio is less than 0.30, and more preferably less than 0.27, and more preferably less than 0.25.

Exemplary embodiments disclosed herein include nickel base superalloy compositions comprising less than about 2.5 wt % Re, and comprising W and Mo in amounts such that the Re ratio is less than 0.3, and wherein an associated P-value is less than about 3360, and more preferably less than about 3245.

Certain embodiments disclosed herein provide at least one of creep rupture, high temperature oxidation resistance, or sustained peak low cycle fatigue resistance comparable to data associated with Rene N5, PWA-1484 and CMSX-4 wherein the superalloy composition comprises less than 3% Re, more preferably less than 2.3% Re, more preferably not more than 2% Re, and wherein the Re ratio is less than 0.3.

Certain embodiments disclosed herein include nickel base superalloys particularly useful in columnar-grained directionally solidified superalloy articles including, for example, embodiments with increased amounts of C (0.06-0.11%), B (0.008-0.015%) and Hf (up to about 1.5%).

Table 1 below provides an exemplary composition series and associated Re ratios and P-values. The values for each composition are given in weight %, the balance being nickel and incidental impurities. For comparative purposes, a nominal composition, Re ratio, and P value is provided for Rene N5.

Table 2 below provides another exemplary composition series, associated Re ratios, and Creep Rupture (CR) data, normalized to a second-generation (i.e. 3% Re) nickel base superalloy. The exemplary compositions in Table 2 provide compositions having about 1 wt % Re which are able to provide desired creep rupture strength. Data from Table 2 as compared to a second-generation alloy (3 wt % Re) and a first generation alloy (0 wt % Re) is presented in FIG. 8.

TABLE 1

| Alloy | Al | Ta | Cr | W | Mo | Re | Co | C | B | Hf | Re | P- |
|---|---|---|---|---|---|---|---|---|---|---|---|---|
| R N5 | 6.2 | 6.5 | 7 | 5 | 1.5 | 3 | 7.5 | 0.05 | 0.004 | 0.15 | 0.46 | 3069 |
| 1 | 6.2 | 6.5 | 6 | 6 | 1.5 | 0 | 7.5 | 0.03 | 0.004 | 0.15 | 0.00 | 3025 |
| 2 | 6.2 | 6.5 | 6 | 6 | 2 | 0 | 7.5 | 0.03 | 0.004 | 0.15 | 0.00 | 3030 |
| 3 | 6.2 | 6.5 | 6 | 6.5 | 1.5 | 0 | 7.5 | 0.03 | 0.004 | 0.15 | 0.00 | 3037 |
| 4 | 6.2 | 6.5 | 6 | 6.5 | 2 | 0 | 7.5 | 0.03 | 0.004 | 0.15 | 0.00 | 3042 |
| 5 | 6.2 | 6.5 | 6 | 6 | 1.5 | 1.5 | 7.5 | 0.03 | 0.004 | 0.15 | 0.20 | 3175 |
| 6 | 6.2 | 6.5 | 6 | 6 | 1.5 | 2 | 7.5 | 0.03 | 0.004 | 0.15 | 0.27 | 3225 |
| 7 | 6.2 | 6.5 | 6 | 6 | 2 | 2 | 7.5 | 0.03 | 0.004 | 0.15 | 0.25 | 3230 |

TABLE 1-continued

| Alloy | Al | Ta | Cr | W | Mo | Re | Co | C | B | Hf | Re | P- |
|---|---|---|---|---|---|---|---|---|---|---|---|---|
| 8 | 6.2 | 6.5 | 6 | 6 | 2 | 1.5 | 7.5 | 0.03 | 0.004 | 0.15 | 0.19 | 3180 |
| 9 | 6.2 | 6.5 | 6 | 6.5 | 1.5 | 1.5 | 7.5 | 0.03 | 0.004 | 0.15 | 0.19 | 3187 |
| 10 | 6.2 | 6.5 | 6 | 6.5 | 1.5 | 2 | 7.5 | 0.03 | 0.004 | 0.15 | 0.25 | 3237 |
| 11 | 6.2 | 6.5 | 6 | 6.5 | 2 | 2 | 7.5 | 0.03 | 0.004 | 0.15 | 0.24 | 3242 |
| 12 | 6.2 | 6.5 | 6 | 6.5 | 2 | 1.5 | 7.5 | 0.03 | 0.004 | 0.15 | 0.18 | 3192 |
| 13 | 6.2 | 6.5 | 6 | 6 | 1.5 | 1.5 | 7.5 | 0.03 | 0.004 | 0.6 | 0.20 | 3099 |
| 14 | 6.2 | 6.5 | 6 | 6.5 | 2 | 1.5 | 7.5 | 0.03 | 0.004 | 0.6 | 0.18 | 3116 |
| 15 | 6.2 | 6.5 | 6 | 6.5 | 1.5 | 0 | 7.5 | 0.03 | 0.004 | 0.6 | 0.00 | 2961 |
| 16 | 6.2 | 6.5 | 6 | 6 | 2 | 0 | 7.5 | 0.03 | 0.004 | 0.6 | 0.00 | 2954 |

TABLE 2

| Alloy | Al | Ta | Cr | W | Mo | Re | Co | C | B | Ti | Re | N. CR |
|---|---|---|---|---|---|---|---|---|---|---|---|---|
| 1A | 6.2 | 7 | 6 | 6.5 | 1.75 | 1 | 7.3 | 0.04 | 0.004 | 0. 3 | 0.14 | 1.03 |
| 2A | 6.2 | 6.5 | 6 | 6.5 | 2.25 | 1 | 7.3 | 0.04 | 0.004 | 0 | 0.18 | 1.05 |
| 3A | 6.2 | 7 | 6 | 6 | 2.25 | 1 | 7.3 | 0.04 | 0.004 | 0 | 0.19 | 1.06 |
| 4A | 6.2 | 6 | 6 | 6.5 | 2.25 | 1 | 7.3 | 0.04 | 0.004 | 0.3 | 0.18 | 1.06 |
| 5A | 6.2 | 6.5 | 6 | 6 | 2.25 | 1 | 7.3 | 0.04 | 0.004 | 0.3 | 0.19 | 1.10 |
| 6A | 6.2 | 7 | 6 | 5.5 | 2.25 | 1 | 7.3 | 0.04 | 0.004 | 0.3 | 0.20 | 1.10 |
| 7A | 6.2 | 6.5 | 6 | 6.5 | 2 | 1 | 7.3 | 0.04 | 0.004 | 0.3 | 0.16 | 1.11 |
| 8A | 6.2 | 7 | 6 | 6 | 2 | 1 | 7.3 | 0.04 | 0.004 | 0.3 | 0.17 | 1.12 |
| 9A | 6.2 | 7 | 6 | 6.5 | 2.25 | 1 | 7.3 | 0.04 | 0.004 | 0 | 0.18 | 1.21 |
| 10A | 6.2 | 6.25 | 6.4 | 6.5 | 2.25 | 1 | 7.5 | 0.04 | 0.004 | 0.3 | 0.17 | 1.25 |
| 11A | 6.2 | 6.5 | 6 | 6.5 | 2.25 | 1 | 7.3 | 0.04 | 0.004 | 0.3 | 0.18 | 1.27 |
| 12A | 6.2 | 7 | 6 | 6.5 | 2 | 1 | 7.3 | 0.04 | 0.004 | 0.3 | 0.16 | 1.30 |
| 13A | 6.2 | 7 | 6 | 6 | 2.25 | 1 | 7.3 | 0.04 | 0.004 | 0.3 | 0.19 | 1.35 |
| 14A | 6.2 | 7 | 6.4 | 6.5 | 2.25 | 1 | 7.5 | 0.04 | 0.004 | 0.3 | 0.17 | 1.38 |
| 15A | 6.2 | 7 | 6.4 | 6 | 2.25 | 1 | 7.5 | 0.04 | 0.004 | 0 | 0.18 | 1.40 |
| 16A | 6.2 | 6.5 | 6.4 | 6.5 | 2.25 | 1 | 7.5 | 0.04 | 0.004 | 0.3 | 0.17 | 1.46 |
| 17A | 6.2 | 7 | 6 | 6.5 | 2.25 | 1 | 7.3 | 0.04 | 0.004 | 0.3 | 0.18 | 1.62 |

Figure 1:
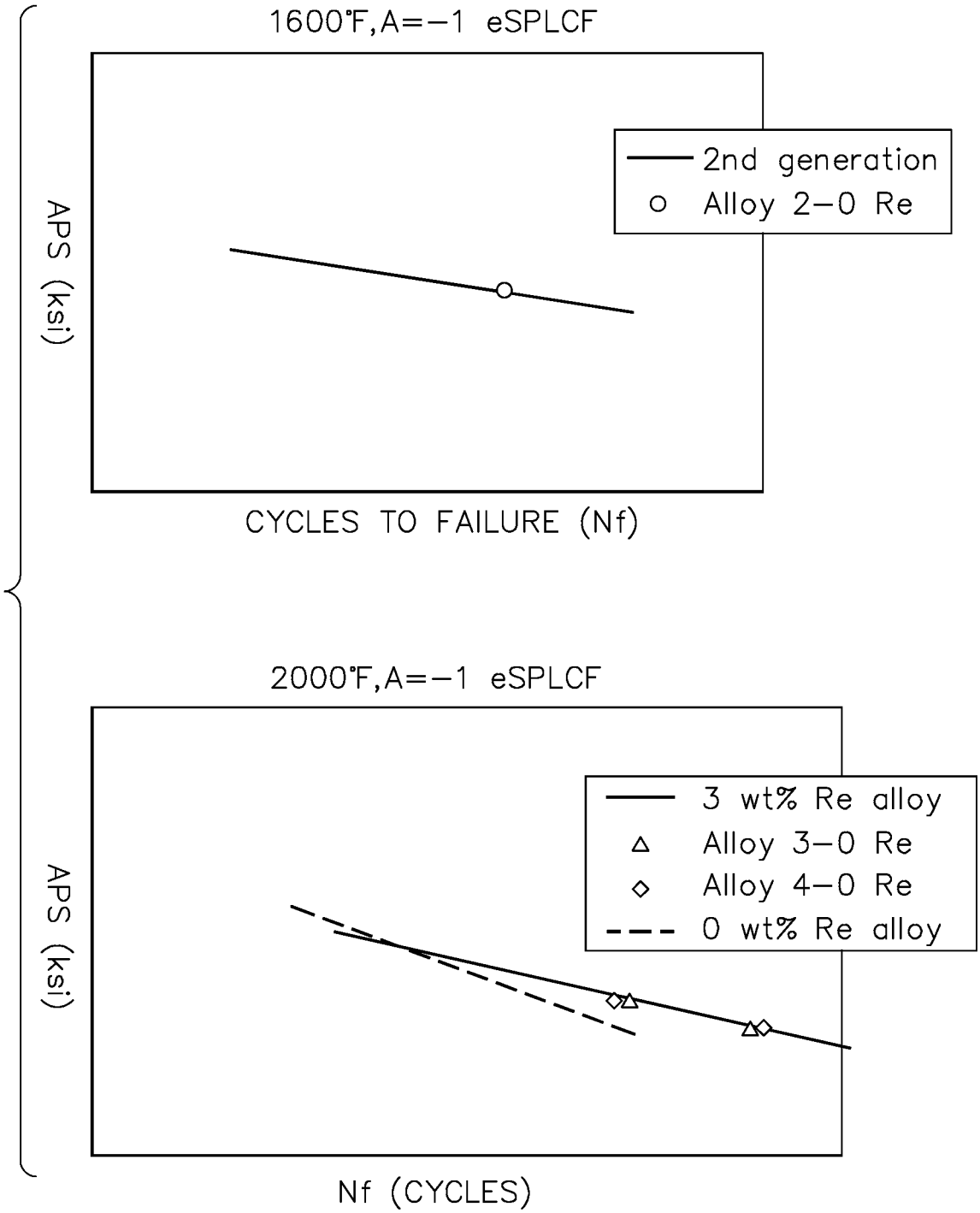
FIG. 1 is a graphical representation of comparative sustained-peak low cycle fatigue (SPLCF) properties.

FIG. 1 illustrates the improved sustained-peak low cycle fatigue (SPLCF) properties of certain embodiments disclosed herein that are beyond that of first-generation superalloys, and more comparable to second-generation superalloys. First generation SC superalloys do not offer thermal mechanical failure (TMF) resistance required in many hot section components. SPLCF is driven by a unique combination of properties, one of which is oxidation resistance. SPLCF or TMF capability is important for cooled hardware because of the temperature gradient within the part.

Figure 2:
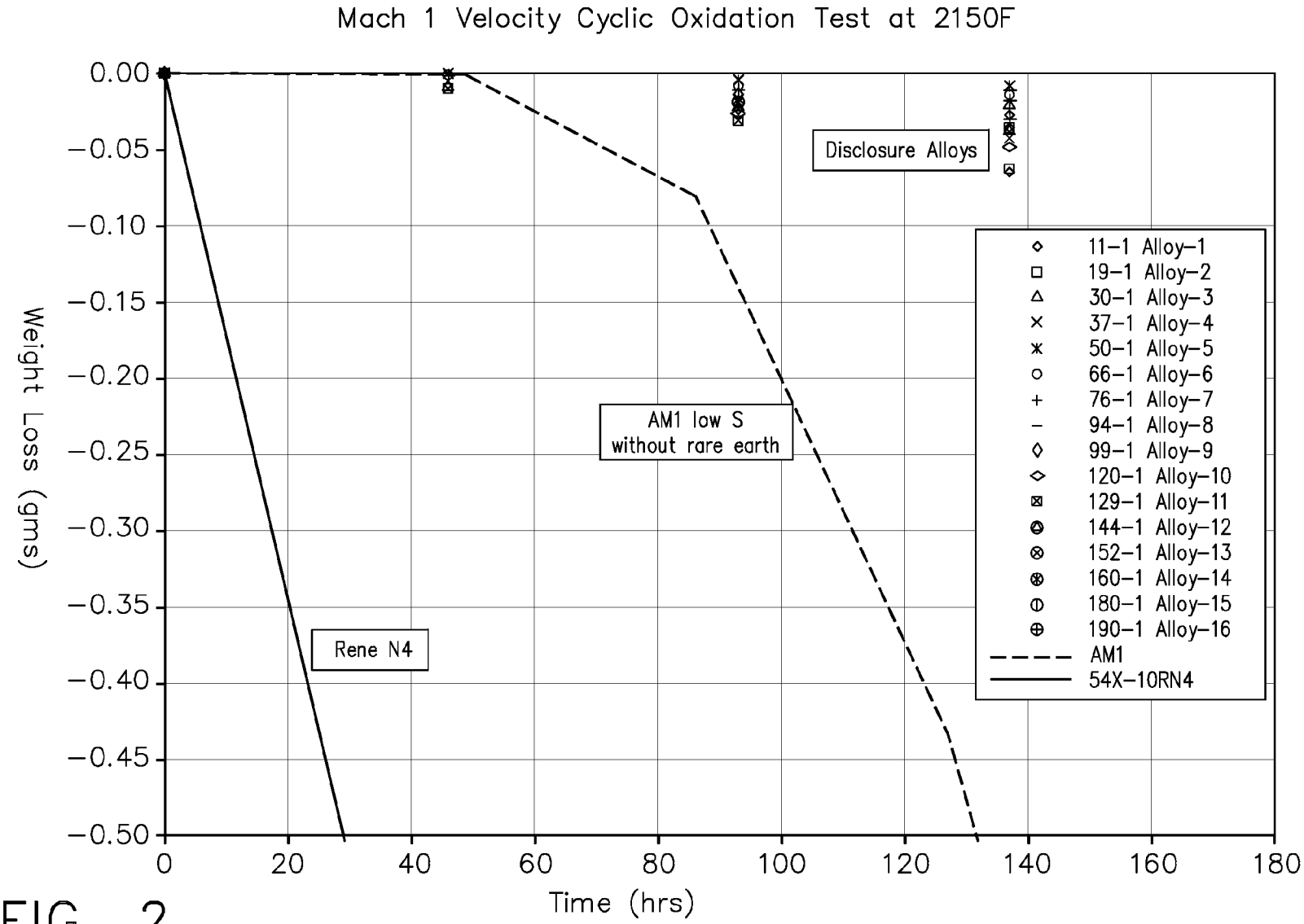
FIG. 2 is a graphical representation of comparative Mach 1 Velocity Cyclic Oxidation Test data at 2150° F.

FIG. 2 provides a comparative graphical representation of data showing weight loss over time during a Mach 1 Velocity Cyclic Oxidation Test at 2150° F., illustrating improved oxidation resistance for certain embodiments disclosed herein.

Figure 3:
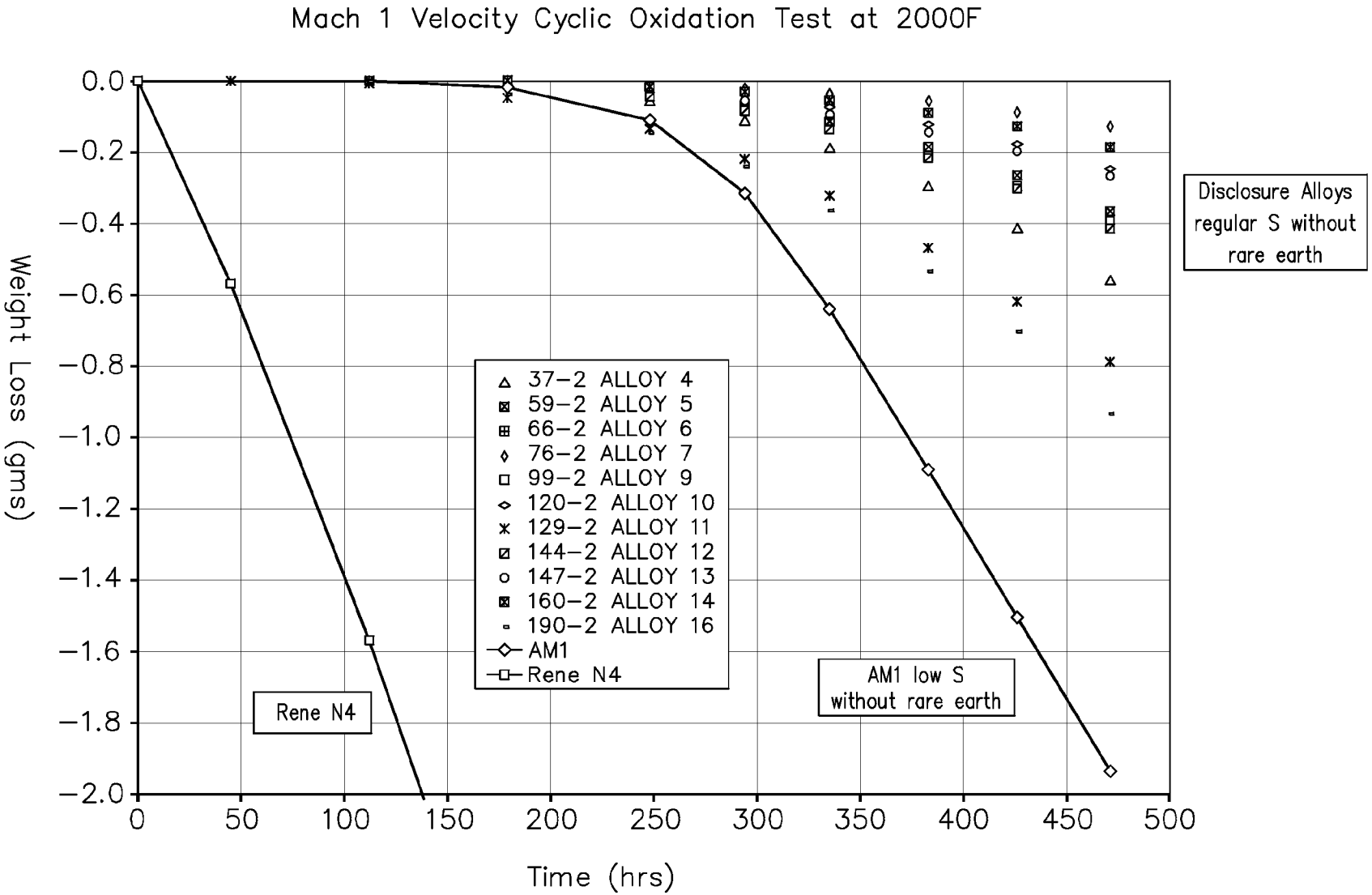
FIG. 3 is a graphical representation of comparative Mach 1 Velocity Cyclic Oxidation Test data at 2000° F.

FIG. 3 provides a comparative graphical representation of data showing weight loss over time during a Mach 1 Velocity Cyclic Oxidation Test at 2000° F., illustrating improved oxidation resistance for certain embodiments disclosed herein.

Figure 4:
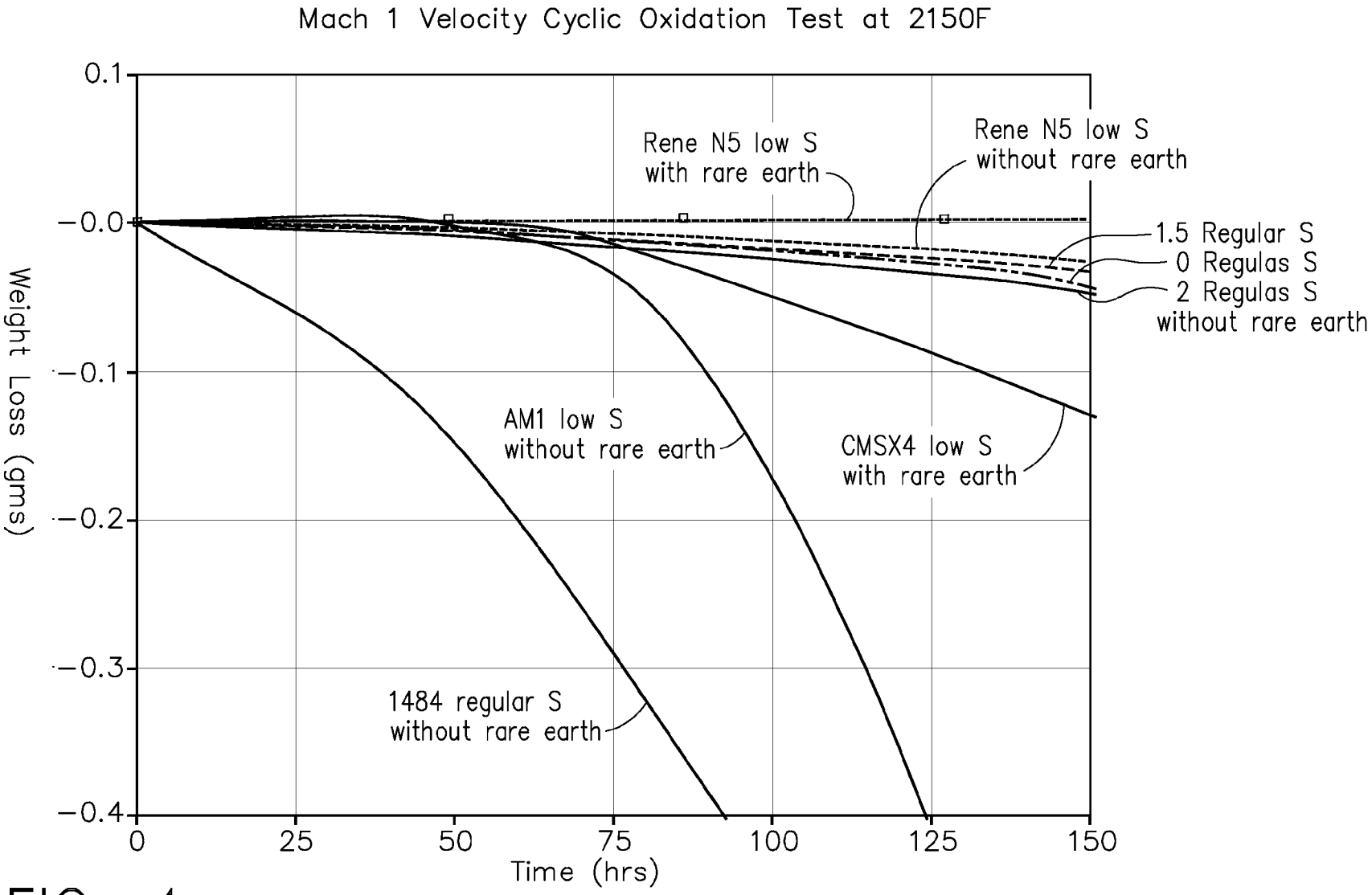
FIG. 4 is a graphical representation of comparative Mach 1 Velocity Cyclic Oxidation Test data at 2150° F.

FIG. 4 provides a comparative graphical representation of data showing weight loss over time during a Mach 1 Velocity Cyclic Oxidation Test at 2000° F., illustrating improved oxidation resistance for certain embodiments disclosed herein.

Figure 5:
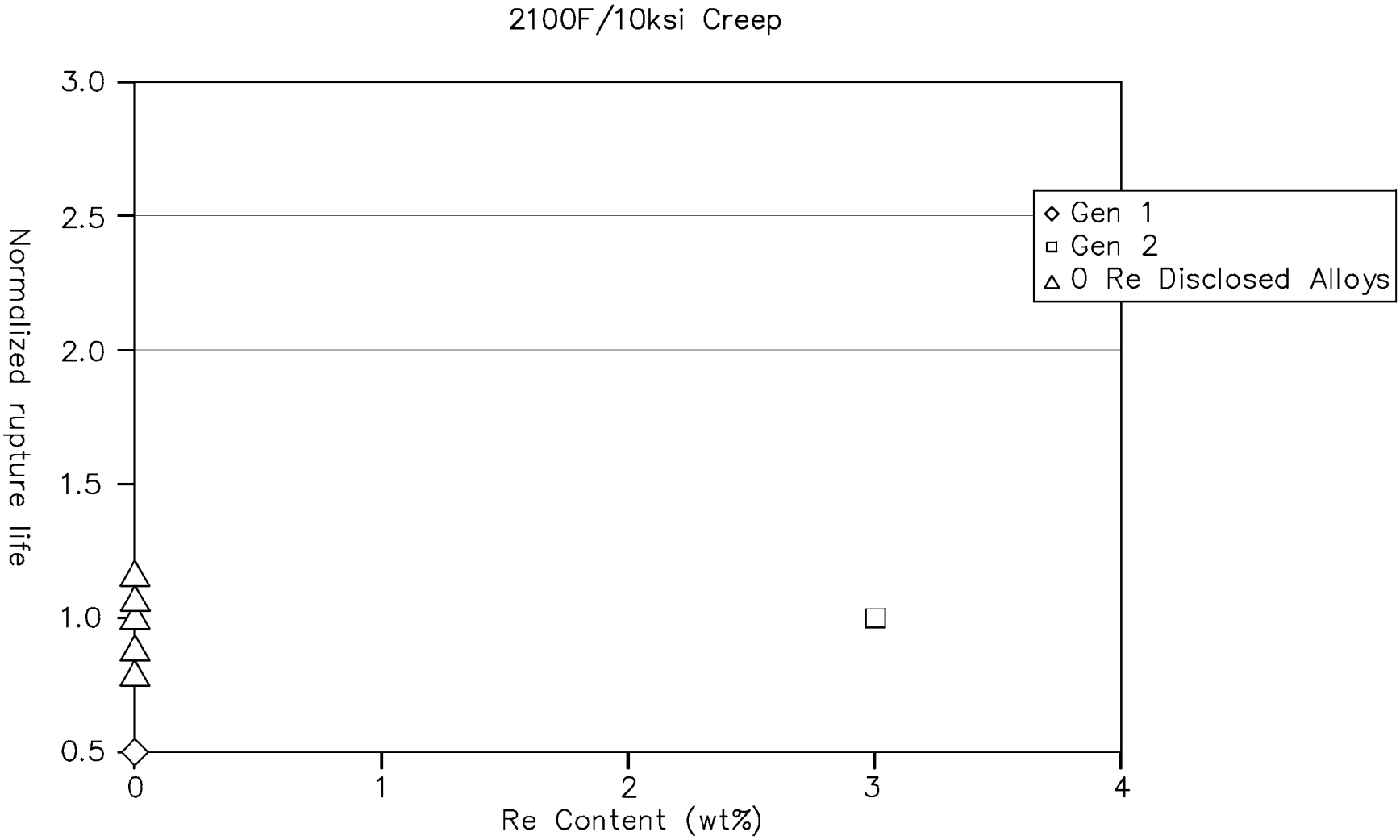
FIG. 5 is a graphical representation of creep rupture data at 2100° F./10 ksi, normalized to a second-generation nickel base superalloy having about 3 wt % Re content.

FIG. 5 is a graphical representation of creep rupture data at 2100° F./10 ksi, normalized to a second-generation nickel base superalloy having about 3 wt % Re content. Certain embodiments disclosed herein compare favorably with the second-generation superalloys, and exhibit marked improvement over first-generation superalloys. It is believed that stability of the gamma prime phase, especially at temperatures in excess of 2100° F., contributes to the improved properties. In certain of the compositions disclosed herein, the volume fraction of the gamma prime phase at 2150° F. is about 46%, comparable to second-generation superalloys, and generally greater than first-generation superalloys. The relative stability of the gamma prime phase benefits the SPLCF resistance and positively affects the creep rupture properties at 2100° F.

Figure 6:
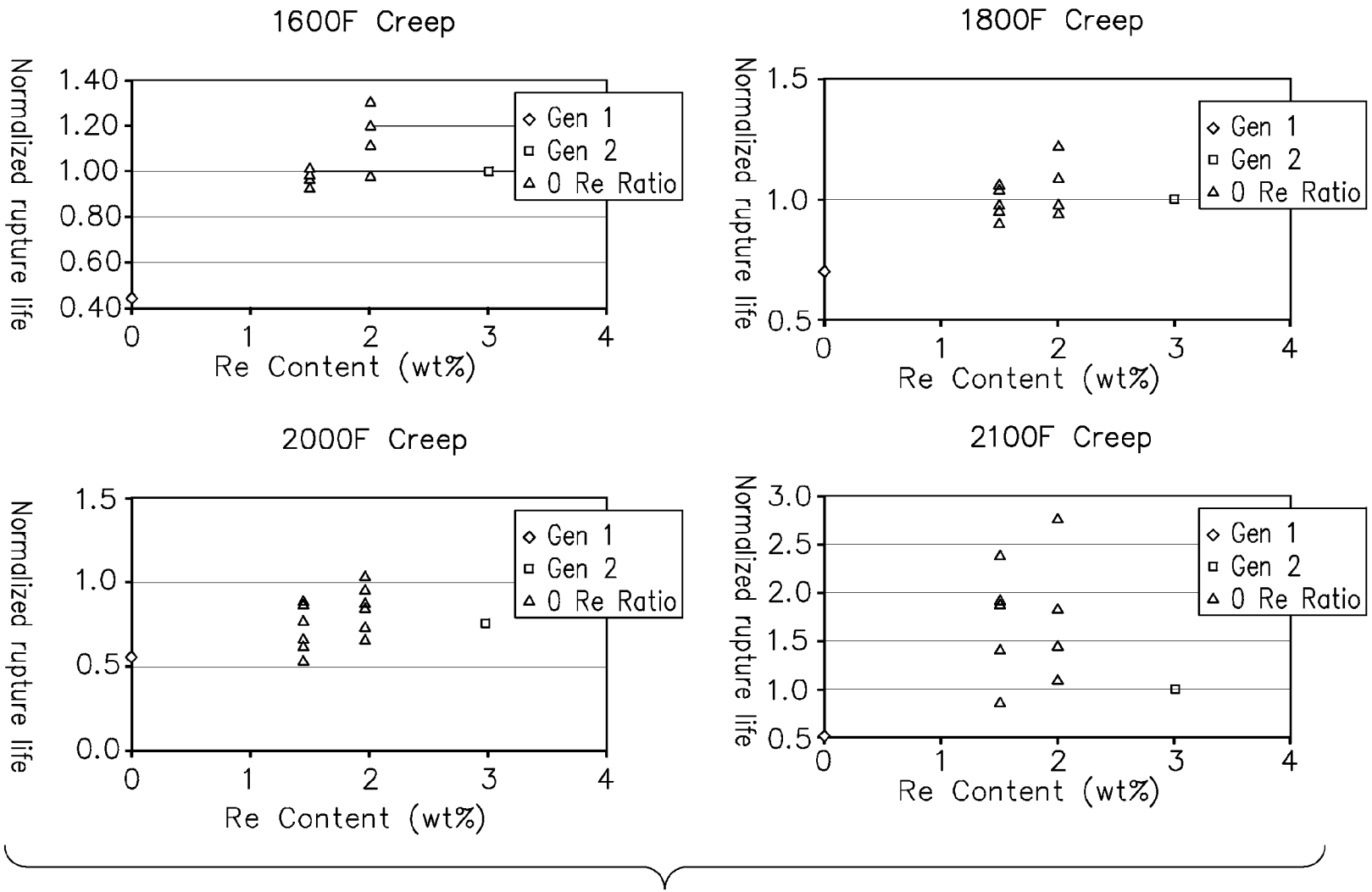
FIG. 6 is a graphical representation of creep rupture data at 1600° F., 1800° F., 2000° F., and 2100° F., normalized to a second-generation nickel base superalloy having about 3 wt % Re.

Creep rupture data, normalized to a second-generation nickel base superalloy illustrate that embodiments disclosed herein having low Re content are more comparable to second-generation superalloys than first-generation superalloys. Normalized creep rupture data at 1600° F., 1800° F., 2000° F., and 2100° F. for alloy 5-alloy 14 (Table 1) is provided in FIG. 6.

Figure 7:
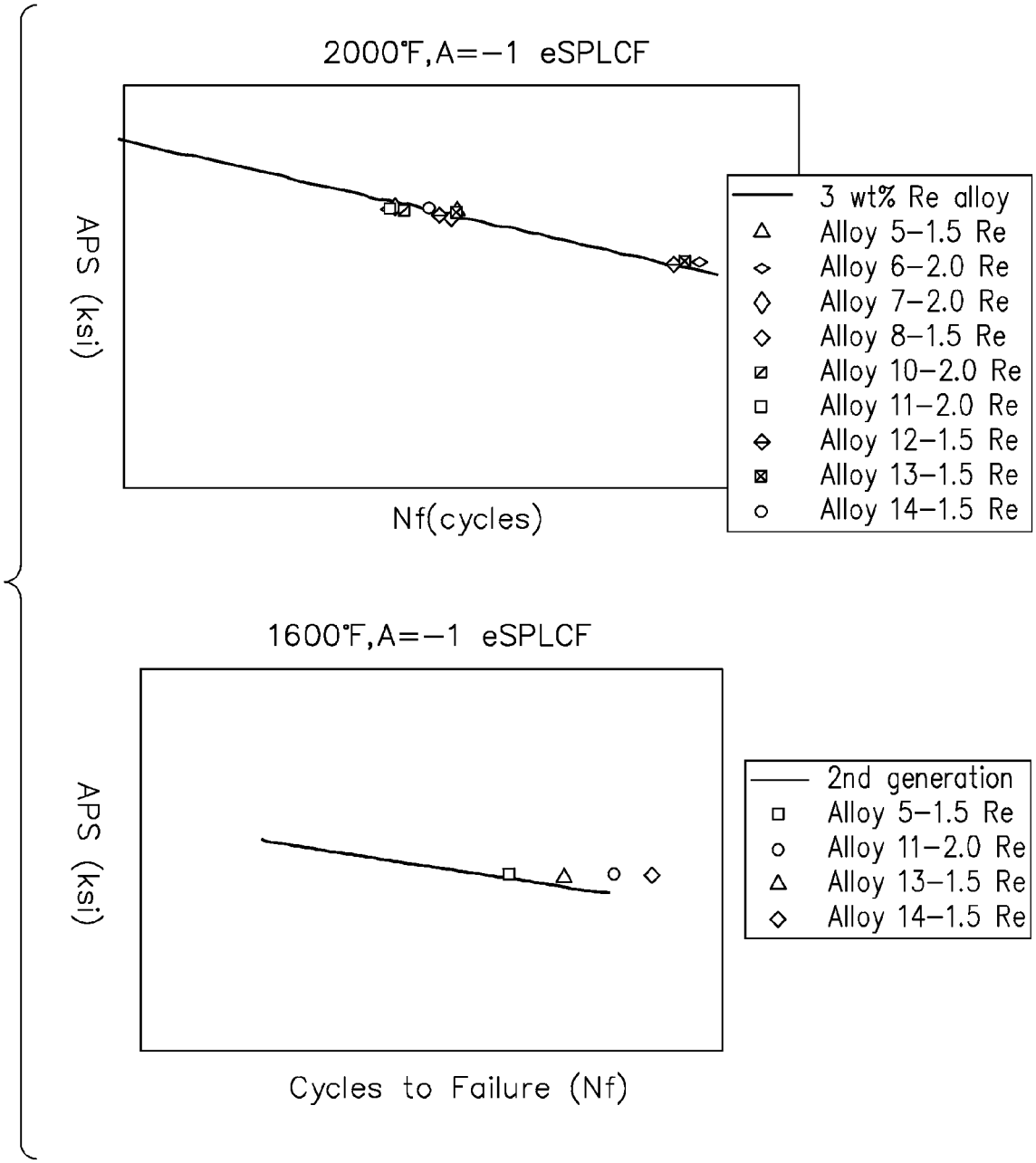
FIG. 7 is a graphical representation of SPLCF data at 2000° F. and 1600° F., normalized to a second-generation nickel base superalloy having about 3 wt % Re.

FIG. 7 is a graphical representation of SPLCF data at 2000° F. and 1600° F., normalized to a second-generation nickel base superalloy having about 3 wt % Re.

Figure 8:
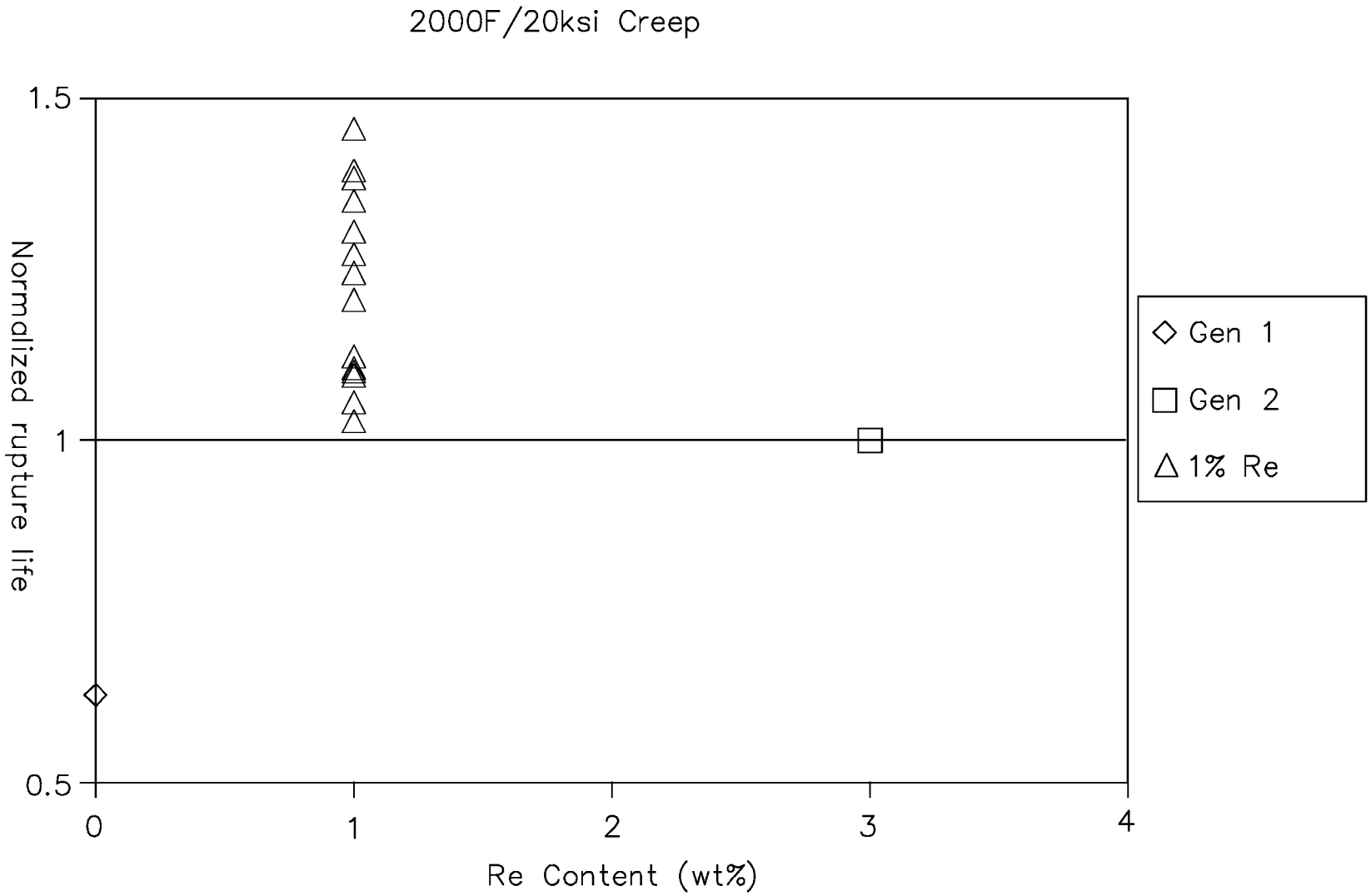
FIG. 8 is a graphical representation of SPLCF data at 2000° F., normalized to a second-generation nickel base superalloy having about 3 wt % Re.

FIG. 8 is a graphical representation of SPLCF data at 2000° F., normalized to a second-generation nickel base superalloy having about 3 wt % Re.

Superalloy compositions disclosed herein may be utilized to produce single crystal articles having temperature capability on par with articles made from second-generation superalloys. An article so produced may be a component for a gas turbine engine. Such an article may be an airfoil member for a gas turbine engine blade or vane. The article so produced may be a nozzle, shroud, splash plate, or other high temperature component.

Certain exemplary embodiments disclosed herein may be especially useful when directionally solidified as hot-section components of aircraft gas turbine engines, particularly rotating blades.

A method for producing any of the articles of manufacture disclosed herein includes preparing a nickel base single crystal superalloy element material having a chemical composition as set forth in the disclosed embodiments, from raw materials containing nickel, cobalt, chromium, molybdenum, tungsten, aluminum, tantalum, optionally titanium, less than 3 wt % rhenium, optionally hafnium, optionally carbon, optionally one or more of yttrium, cesium, and lanthanum. The superalloy element material is subjected to suitable heat treatment and suitable subsequent casting processes.

Thus, superalloy compositions disclosed herein provide the desired thermal mechanical properties, creep strength, and oxidation resistance with reduced Re content by balancing the contributions of compositional elements.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A nickel base superalloy composition consisting of, in percentages by weight:

5-8 Cr; 6.5-9 Co; 1.5-2.0 Mo; 6.0-6.5 W; 6.0-7.0 Ta; 6.0-6.4 Al; 1 to 1.5 Re; 0.6 to 0.7 Hf; 0.03 to 1.5 C; 0.004 to 0.015 B; if present, up to 0.03 total of a rare earth selected from Y, La, and Ce, and mixtures thereof; the balance being nickel and incidental impurities;

wherein the superalloy composition exhibits creep rupture strength properties of at least 275 hours at a temperature of about 1600° F. (871° C.) and a cyclic load of about 70 ksi (483 MPa);

wherein the superalloy composition exhibits creep rupture strength properties of at least 240 hours at a temperature of about 2100° F. (1149° C.) and a cyclic load of about 10 ksi (69 MPa);

wherein the superalloy composition exhibits sustained-peak low cycle fatigue (SPLCF) properties of at least 6200 cycles at a temperature of about 2000° F. (1093° C.) and a cyclic load of about 22 ksi (152 MPa);

wherein the superalloy composition exhibits sustained-peak low cycle fatigue (SPLCF) properties of at least 2700 cycles at a temperature of about 2000° F. (1093° C.) and a cyclic load of about 30 ksi (207 MPa);

wherein an Re ratio defined as the weight % of Re relative to the total of the weight % of W and the wt % of Mo, is less than 0.27.

2. The nickel base superalloy composition according to claim 1 consisting of, in percentages by weight:

6-7 Cr; 7.5 Co; 1.5-2.0 Mo; 6.0-6.5 W; 6.5 Ta; 6.2 Al; 1.5 Re; 0.6 Hf; 0.03-0.05 C; 0.004 B; the balance being nickel and incidental impurities.

3. The nickel base superalloy composition according to claim 1 consisting of, in percentages by weight:

6.0 Cr; 7.5 Co; 1.5 Mo; 6.0 W; 6.5 Ta; 6.2 Al; 1.5 Re; 0.6 Hf; 0.03 C; 0.004 B; the balance being nickel and incidental impurities.

4. The nickel base superalloy composition according to claim 1 consisting of, in percentages by weight:

6.0 Cr; 7.5 Co; 2.0 Mo; 6.5 W; 6.5 Ta; 6.2 Al; 1.5 Re; 0.6 Hf; 0.03 C; 0.004 B; the balance being nickel and incidental impurities.

5. The nickel base superalloy composition according to claim 4 wherein the superalloy composition exhibits creep rupture strength properties of at least 140 hours at a temperature of about 1800° F. (982° C.) and a cyclic load of about 35 ksi (241 MPa).

6. The nickel base superalloy composition according to claim 1 wherein the Re ratio is less than 0.25.

7. The nickel base superalloy composition according to claim 1 being characterized by a P-value of 3099 to 3116, wherein the P-value is defined as: $P=-200\ Cr+80\ Mo-20\ Mo^2-250\ Ti^2-50(Ti\times Ta)+15\ Cb+200\ W-14\ W^2+30\ Ta-1.5\ Ta^2+2.5\ Co+1200\ Al-100\ Al^2+100\ Re+1000\ Hf-2000\ Hf^2+700\ Hf^3-2000\ V-500\ C-15000\ B-500\ Zr$.

8. The nickel base superalloy composition according to claim 7 wherein the P-value is in a range of from 2954 to 3242.

9. The nickel base superalloy composition according to claim 1 wherein the superalloy composition exhibits Mach 1 velocity cyclic oxidation properties at 2000° F. and 2150° F. (1093° C. and 1177° C.) comparable to superalloy compositions having at least 3 wt % Re.

10. The nickel base superalloy composition according to claim 1 wherein the superalloy composition exhibits creep rupture strength properties at temperatures up to 2100° F. (1149° C.) comparable to superalloy compositions having at least 3 wt % Re.

11. A nickel base single-crystal article comprising a superalloy consisting of, in percentages by weight:

5-8 Cr; 6.5-9 Co; 1.5-2.0 Mo; 6.0-6.5 W; 6.0-7.0 Ta; 6.0-6.4 Al; 1 to 1.5 Re; 0.6 to 0.7 Hf; 0.03 to 1.5 C; 0.004 to 0.015 B; the balance being nickel and incidental impurities;

wherein the superalloy composition exhibits creep rupture strength properties of at least 275 hours at a temperature of about 1600° F. (871° C.) and a cyclic load of about 70 ksi (483 MPa);

wherein the superalloy composition exhibits creep rupture strength properties of at least 240 hours at a temperature of about 2100° F. (1149° C.) and a cyclic load of about 10 ksi (69 MPa);

wherein the superalloy composition exhibits sustained-peak low cycle fatigue (SPLCF) properties of at least 6200 cycles at a temperature of about 2000° F. (1093° C.) and a cyclic load of about 22 ksi (152 MPa);

wherein the superalloy composition exhibits sustained-peak low cycle fatigue (SPLCF) properties of at least 2700 cycles at a temperature of about 2000° F. (1093° C.) and a cyclic load of about 30 ksi (207 MPa).

12. The nickel base single-crystal article according to claim 11, wherein the article is chosen from the group consisting of a turbine blade, a turbine vane, a nozzle, a shroud, and a splash plate.

13. The nickel base single-crystal article according to claim 11 wherein the superalloy has an Re ratio, defined as the weight % of Re relative to the total of the weight % of W and the wt % of Mo, of less than 0.25.

14. The nickel base single-crystal article according to claim 11 wherein the superalloy provides at least one of creep rupture, high temperature oxidation resistance, or sustained peak low cycle fatigue resistance comparable to superalloys having at least 3% by weight rhenium.

15. The nickel base single-crystal article according to claim 11 wherein the superalloy consists of, in percentages by weight:

6.0 Cr; 7.5 Co; 1.5 Mo; 6.0 W; 6.5 Ta; 6.2 Al; 1.5 Re; 0.6 Hf; 0.03 C; 0.004 B; the balance being nickel and incidental impurities.

16. The nickel base single-crystal article according to claim 11 wherein the superalloy consists of, in percentages by weight:

6.0 Cr; 7.5 Co; 2.0 Mo; 6.5 W; 6.5 Ta; 6.2 Al; 1.5 Re; 0.6 Hf; 0.03 C; 0.004 B; the balance being nickel and incidental impurities.

17. A gas turbine engine component cast from a nickel base superalloy composition comprising:

5-8 Cr; 6.5-9 Co; 1.5-2.0 Mo; 6.0-6.5 W; 6.0-7.0 Ta; 6.0-6.4 Al; 1 to 1.5 Re; 0.6 to 0.7 Hf; 0.03 to 1.5 C; 0.004 to 0.015 B; the balance being nickel and incidental impurities;

wherein the superalloy composition exhibits creep rupture strength properties of at least 275 hours at a temperature of about 1600° F. (871° C.) and a cyclic load of about 70 ksi (483 MPa);

wherein the superalloy composition exhibits creep rupture strength properties of at least 240 hours at a temperature of about 2100° F. (1149° C.) and a cyclic load of about 10 ksi (69 MPa);

wherein the superalloy composition exhibits sustained-peak low cycle fatigue (SPLCF) properties of at least 6200 cycles at a temperature of about 2000° F. (1093° C.) and a cyclic load of about 22 ksi (152 MPa);

wherein the superalloy composition exhibits sustained-peak low cycle fatigue (SPLCF) properties of at least 2700 cycles at a temperature of about 2000° F. (1093° C.) and a cyclic load of about 30 ksi (207 MPa);

wherein an Re ratio defined as the weight % of Re relative to the total of the weight % of W and the wt % of Mo, is less than 0.27.

18. The gas turbine engine component according to claim 17, wherein the article is a single crystal casting.

19. The gas turbine engine component according to claim 17, wherein the article is a directionally solidified casting.

20. The gas turbine engine component according to claim 17, wherein the article is chosen from the group consisting of an airfoil member for a gas turbine engine blade, an airfoil member for a gas turbine engine vane, a nozzle, a shroud, and a splash plate.

* * * * *

UNITED STATES PATENT AND TRADEMARK OFFICE

CERTIFICATE OF CORRECTION

PATENT NO. : 8,876,989 B2
APPLICATION NO. : 11/964664
DATED : November 4, 2014
INVENTOR(S) : O'Hara et al.

It is certified that error appears in the above-identified patent and that said Letters Patent is hereby corrected as shown below:

In the drawings

In Fig. 4, Sheet 4 of 9, delete "— 0 Regulas S — 2 Regulas S" and insert -- — 0 Regular S — 2 Regular S --, therefor.

In the specification

In Column 5, Lines 32-37, delete "An exemplary embodiment includes a nickel base superalloy that may be utilized to produce single crystal articles, the superalloy including, in percentages by weight: 5-8 Cr, 6.5-9 Co, 1.3-2.5 Mo, 4.8-6.8 W, 6.0-7.0 Ta, 0.05-0.5 Ti, 6.0-6.4 Al, 1.0-2.3 Re, 0.15-0.6 Hf, 0-1.5 C, 0-0.015 B, with the balance including nickel and incidental impurities".

In Column 5, Line 43, delete "impurities." and insert -- impurities.
An exemplary embodiment includes a nickel base superalloy comprising, in nominal composition: 6.0 Cr, 7.5 Co, 2.0 Mo, 6.0 W, 6.5 Ta, 0 Ti, 6.2 Al, 1.5 Re, 0.15 to 0.6 Hf, 0.03-0.06 C, 0.004 B, the balance being nickel and incidental impurities. --, therefor.

Signed and Sealed this
Twenty-second Day of March, 2016

Michelle K. Lee

Michelle K. Lee
*Director of the United States Patent and Trademark Office*